United States Patent [19]

Dutton

[11] Patent Number: 4,728,147

[45] Date of Patent: Mar. 1, 1988

[54] LAWN CHAIR ACCESSORY

[76] Inventor: Ronald W. Dutton, 5614 Circlegate, Spring, Tex. 77373

[21] Appl. No.: 890,926

[22] Filed: Jul. 31, 1986

[51] Int. Cl.[4] ..... A47C 7/62

[52] U.S. Cl. ..... 297/194; 297/DIG. 6; 248/231

[58] Field of Search ..... 297/188, 194, DIG. 6, 297/135, 148, 153, 160; 248/205.2, 231; 24/306; 108/26

[56] References Cited

U.S. PATENT DOCUMENTS

| | | | |
|---|---|---|---|
| 3,233,940 | 2/1966 | Tooley, Jr. | 297/194 |
| 3,338,628 | 8/1967 | Evans | 297/188 |
| 3,383,738 | 5/1968 | Fox et al. | 24/306 |
| 3,586,368 | 6/1971 | Guild | 297/188 X |
| 4,597,031 | 6/1986 | Tsuyama | 248/231 X |
| 4,662,676 | 5/1987 | Havelock | 297/194 |

*Primary Examiner*—Kenneth J. Dorner
*Assistant Examiner*—Peter R. Brown

[57] ABSTRACT

An apparatus is disclosed which is to be used to hold styrofoam cup holders, styrofoam cups, drink cans, books, glasses and etc. The apparatus is to be preferably attached to an arm of a lawn chair by a hook and loop fastener. It will be made of colored plastic of sufficient strength. It will slide easily over the arm of the vast majority of lawn chairs. Then fasten to the arm of the chair easily. It is designed and will be manufactured for the arms of lawn chairs.

1 Claim, 10 Drawing Figures

FIG. 1
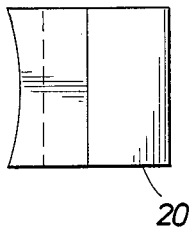
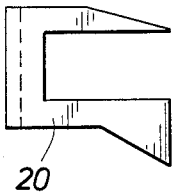
FIG. 2
FIG. 3
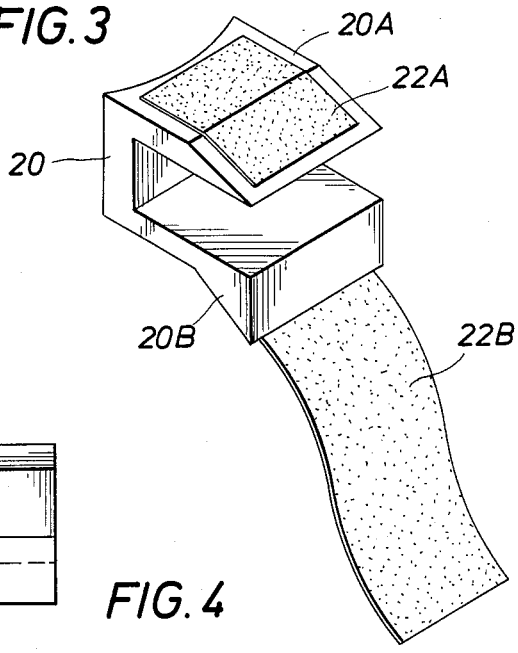
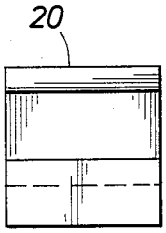
FIG. 4
FIG. 5
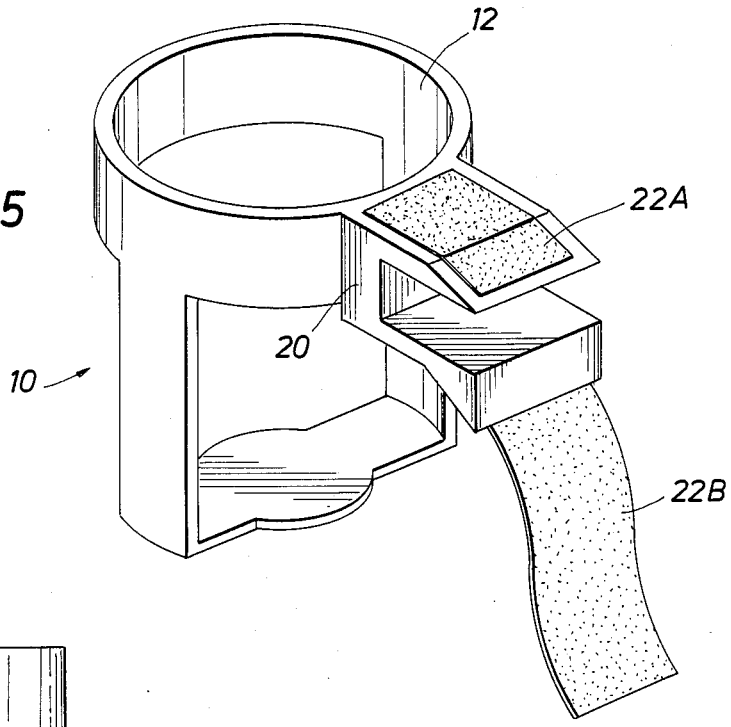
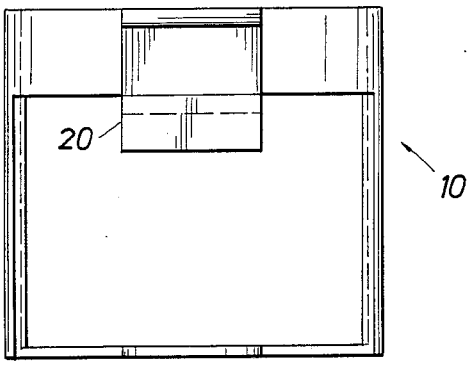
FIG. 6

FIG. 7
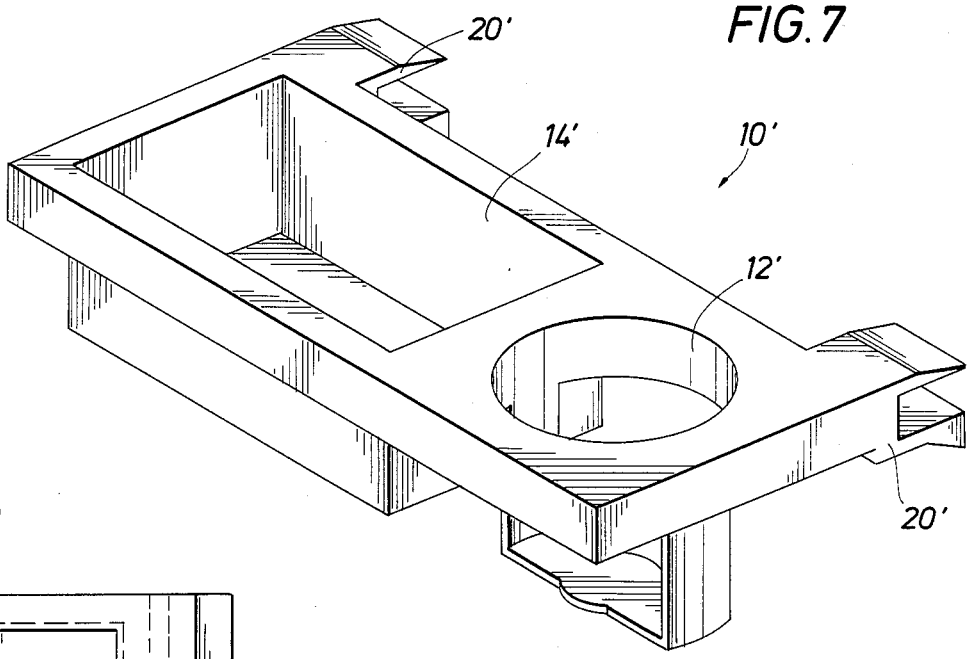
FIG. 8
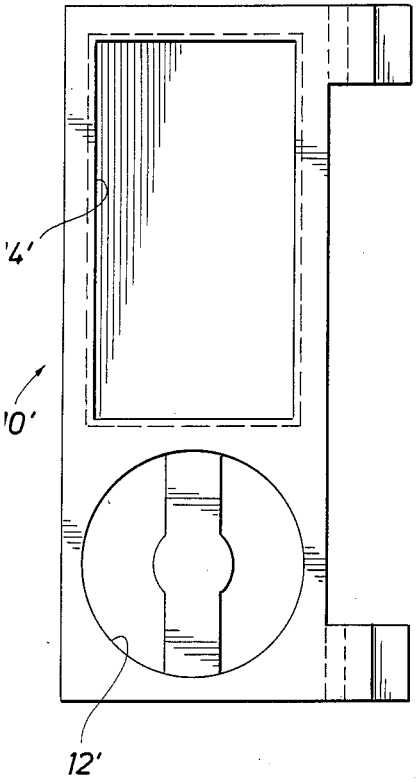
FIG. 9
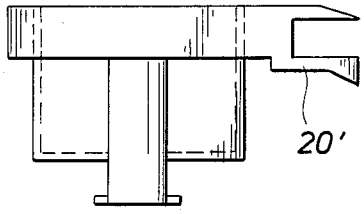
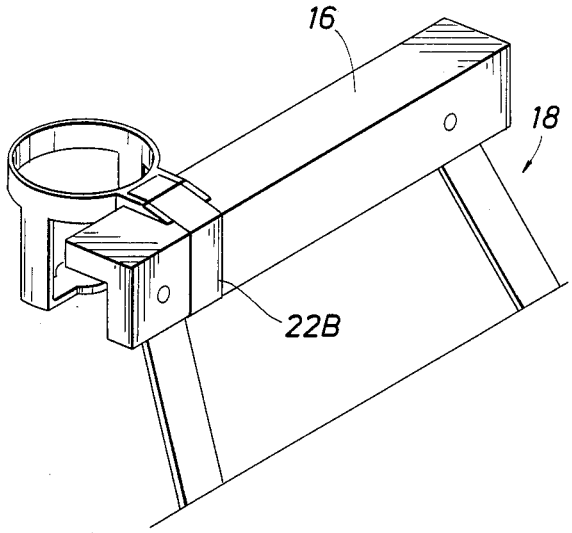
FIG. 10

LAWN CHAIR ACCESSORY

BRIEF SUMMARY

This invention is unique because no one has made an item like this to help the lawn chair user (owner). It is needed for people with lawn chairs, all being used outside the home, such as at the beach, at a lake, fishing, or hunting. It is very convenient and helpful. It keeps the cup or canned beverage in a holder and not in your hand, lap, or on the ground, therefore freeing your hands and saving messy spills. Also the tray version can hold eye glasses, a book, suntan lotion, etc. It easily attaches to the lawn chair arms for use by the lawn chair user.

THE DESCRIPTION OF THE DRAWINGS

The objects, advantages and features of the invention will become more apparent by reference to the drawings which are appended hereto and wherein like numerals indicate like parts and wherein an illustrative embodiment of the invention is shown, of which:

FIGS. 1, 2, 3, 4, its design of fitting to and over lawn chair arms, for can, cup, and tray holders.

FIGS. 5, 6 complete can and cup holder assembly with velcro.

FIG. 7 tray holder with two ends for holding to chair arms.

FIGS. 8, 9 tray holder with solid design of fitting to chair arms.

FIG. 10 a cup, can, and beverage holder assembly, complete and installed on a lawn chair arm, with velcro as its attaching method, ready to use.

DETAILED DESCRIPTION OF THE INVENTION

The preferred embodiment of Lawn Chair apparatus 10 as illustrated in FIGS. 5, 6, and 10, when completely assembled is a can holder 12 and cup holder. An alternative embodiment as shown in FIGS. 7, 8 and 9 is a miscellaneous holder means or service tray 14 especially made for the arms of lawn chairs. This invention allows the chair user to be able to set his or her cup, can or other item into or onto this holder while it is attached to the chair arm. This allows the chair user to have the use of his hands for other things, such as to read or etc. It is easily attached to the chair arm, as shown in the drawings. It will be made of colored plastic, of sufficient strength, and will fit over and attach to the arms of the lawn chairs as illustrated in FIG. 10.

This item is to be used for holding cups, cans, etc., by first mounting it on the chair arm. It can be put on the the right arm 16 or left arm (not shown) of the lawn chair 18 or on both.

It can be installed by these following methods;

1. Velcro ® hook and loop fastener—just wrap around arm and tighten.
2. Glue—apply glue and install
3. Screws—use to fasten on chair arms
4. Bolt and nut—use to fasten on chair arms
5. Rivets—use to fasten on chair arms
6. Clamp or clamps—use to fasten on chair arms
7. Molded into arm of chairs—by lawn chair manufacturer only The use of a hook and loop fastener is the preferred embodiment as shown in FIGS. 3, 5 and 10.

This apparatus will be made of plastic (injection molded), except the items to secure it to the chair arms, such as the hook and loop fastener. Items to secure it with will be added to molded part in the mold or afterwards by an assembly process, making it ready for use.

The apparatus will provide the following advantages to the user:

1. It will free his or hers hands for other things while sitting in a lawn chair.
2. It is strictly designed and invented for installing on and using with lawn chairs.
3. It is installed very fast and is capable of holding styrofoam cup holders, styrofoam cups, drink cans, and trays.
4. It will hold them firmly and rigidly.
5. It eliminates the chair owner, user from having to continue holding his cup or can while not actually drinking from it.
6. It will also eliminate having to set your cup or can on the ground, which will eliminate a lot of spills and insects getting into the beverage.
7. If you are at a beach it will eliminate you from having to set your cup or can on the gritty and hot sand.
8. If someone wants to hold a child or read a book, while drinking, he or she does not have to set the container on the ground or try to hold on to it with their hands or knees.
9. It is made of colored plastic and it is installed by the above disclosed fasteners.

The device known as the lawn chair mate, molded as a cup holder as one unit, and as tray holders as units, all complete units. It will be molded to make a cup holder, to make a complete unit as shown in FIGS. 5, 6 and 10. And molded to make the trays to make complete units. This invention includes its design and method, (molded together as a cup holder or trays), for holding cups, cans and etc. to the arms of lawn chairs.

All which will be manufactured and assembled to be sold as complete units! They will be manufactured of plastic, except the attaching (to the arm of the chair) material. Buyers will have choice of cup holder as complete unit and or trays as complete units. All ready to install and use when needed!

Again, the invention includes the complete unit with cup holder and the complete units with tray holders, all to be used on the arms of lawn chairs. The invention includes its method and design of fitting to and over the arms of lawn chairs, see FIGS. 3, 5 and 10. The complete products will be ready to fit to the lawn chair arms, and ready to be attached and used by the chair user, owner.

The apparatus 10 adapted for releasably mounting to an arm 16 of a chair 18 comprises a service tray 12, a rigid U shaped clamp means 20 sized for mounting of the service tray 12 to the chair arm 16, and a strap connector means 22A and 22B disposed on said clamp means 20 for adjustably and releasably fastening of the service tray 12 to the chair arm 16 to operably allow adjustable mounting of the service tray to a plurality of chair arm sizes.

The strap connector means 22A and 22B preferably includes a hook and loop fastener. The clamp means 20 includes a first leg 20A and a second leg 20B. The hook portion 22A is preferably fixedly secured to the first leg 20A and therefore the loop portion 22B is fixedly secured to the second leg 20B. The loop portion 22B is adapted for adjustably fastening of the hook portion 22A to operably allow adjustable mounting of the service tray to a plurality of chair arms sizes.

An alternative embodiment, as shown in FIGS. 7, 8 and 9, further comprises a holder means 14 in addition to the receptacle means 12 for holding a glass or cup. The alternative embodiment further includes a plurality of spaced apart clamp means 20' to operably allow a plurality of adjustable mountings for the apparatus as disclosed above.

Various modifications and alterations in the disclosed apparatus and methods will be apparent to those skilled in the art of the foregoing description which does not depart from the spirit of the invention. For this reason, these changes are desired to be included in the appended claims. The appended claims recite only the limitation to the present invention in the descriptive manner which is employed for setting forth the embodiments and is to be interpreted as illustrative and not limitative.

I claim:

1. Apparatus adapted for releasably mounting to an arm of a lawn chair which comprises:

a service tray, a rigid U-shaped clamp means sized for mounting of the service tray to the lawn chair arm, a strap connector means disposed on said clamp means for adjustably and releasably fastening of the service tray to the chair arm independent of other fastening devices said strap connector means includes a hook portion and a loop portion, said clamp means having a first leg and a second leg, and said hook portion fixedly secured to one of said legs and one end of said loop portion fixed to the other of said legs, the other end of said loop portion adapted for adjustably fastening to said hook portion to operably allow adjustable mounting of said service tray to a plurality of lawn chair arm sizes.

* * * * *